US008128534B2

(12) United States Patent
Crawford

(10) Patent No.: US 8,128,534 B2
(45) Date of Patent: Mar. 6, 2012

(54) TRAMPOLINE

(75) Inventor: Timothy Crawford, Golden, CO (US)

(73) Assignee: Jump-Street, LLC, Golden, CO (US)

( * ) Notice: Subject to any disclaimer, the term of this patent is extended or adjusted under 35 U.S.C. 154(b) by 0 days.

(21) Appl. No.: 12/708,386

(22) Filed: Feb. 18, 2010

(65) Prior Publication Data

US 2010/0210422 A1 Aug. 19, 2010

Related U.S. Application Data

(60) Provisional application No. 61/153,932, filed on Feb. 19, 2009.

(51) Int. Cl.
*A63B 21/00* (2006.01)

(52) U.S. Cl. ..... 482/27; 482/28

(58) Field of Classification Search ..... 482/27–29; 182/139

See application file for complete search history.

(56) References Cited

U.S. PATENT DOCUMENTS

| | | | | |
|---|---|---|---|---|
| 3,233,895 | A * | 2/1966 | Grelle et al. | 482/27 |
| 4,331,329 | A * | 5/1982 | Mirkovich et al. | 482/27 |
| 6,402,662 | B1 * | 6/2002 | Rieber | 482/27 |
| 2007/0010374 | A1 * | 1/2007 | Widich | 482/27 |

* cited by examiner

*Primary Examiner* — Jerome W Donnelly
(74) *Attorney, Agent, or Firm* — Klass, Law, O'Meara & Malkin, P.C.; Robert W. Nelson, Esq

(57) ABSTRACT

Trampolines are disclosed herein. An embodiment of a trampoline includes a first support member having a plurality of portions and a second support member having a plurality of portions. A first support member first portion is aligned with a second support member second portion wherein the area between the first support member first portion and the second member first portion is a first plane. A first support member second portion is aligned with a second support member second portion wherein the area between the first support member second portion and the second support member second portion is a second plane. A single piece of first material substantially covers the first plane and the second plane. The first plane intersects the second plane at an angle less than one hundred eighty degrees.

14 Claims, 3 Drawing Sheets

TRAMPOLINE

This application claims priority from U.S. patent application Ser. No. 61/153,932, filed on Feb. 19, 2009, for TRAMPOLINE, which is hereby incorporated by reference for all that is disclosed therein.

BACKGROUND

When a plurality of trampolines are placed adjacent one another, a trampoline court is created. However, the support members of the plurality of trampolines create significant areas in the court where no bounce is achieved. The support members significantly reduce the effective bounce area of the trampoline court.

DETAILED DESCRIPTION

Trampoline courts are created by placing a plurality of trampolines adjacent one another. The problem with creating these trampoline courts is that the support members of the trampolines reduce the effective bouncing area of the trampoline court. The effective bouncing area is an area where a user of the trampoline court is able to effectively use the trampoline to bounce. The effective bounce area does not exist on the support members or in the vicinity of the support members.

Figure 1:
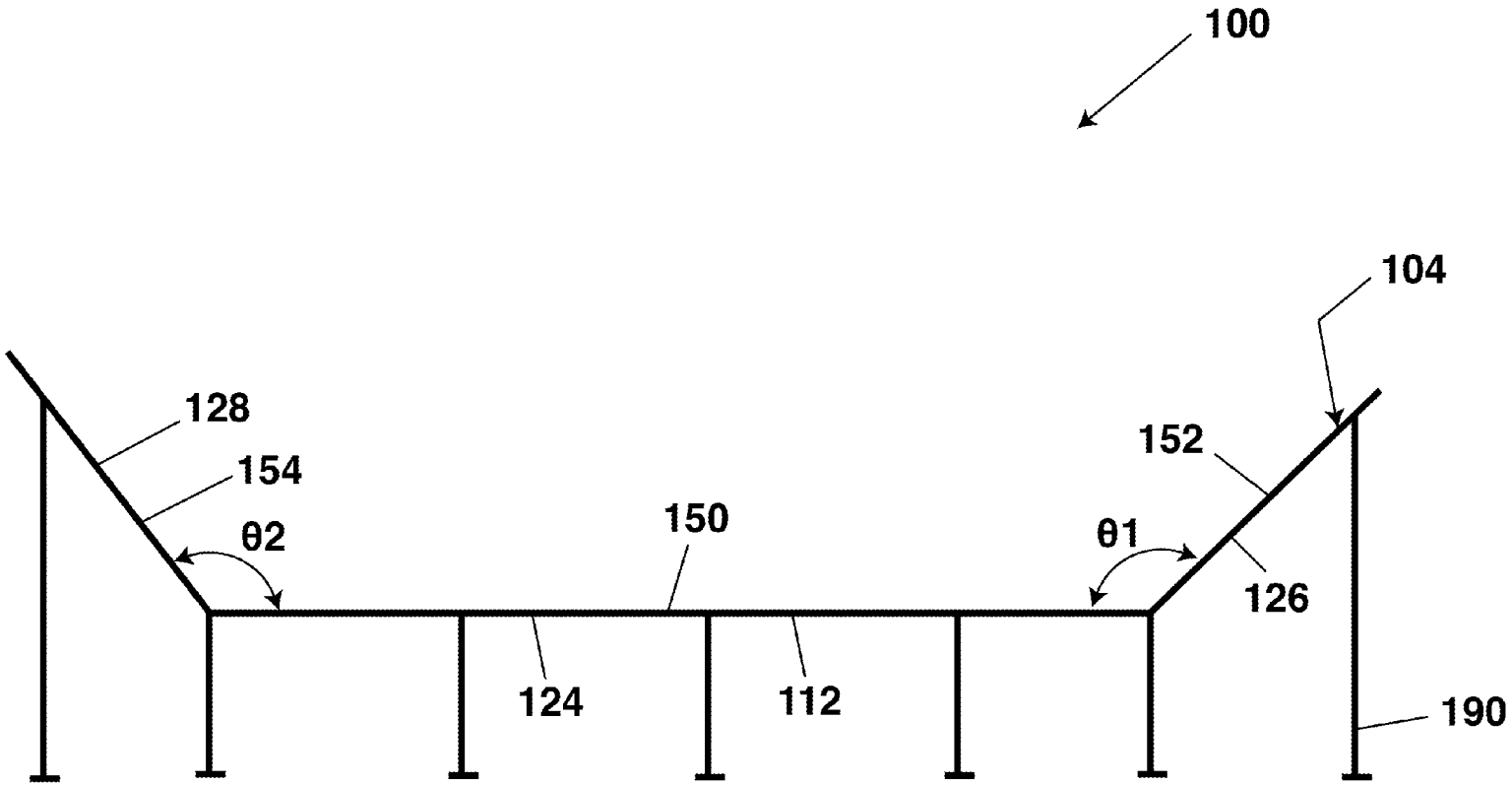
FIG. 1 is a side elevation view of an embodiment of a trampoline.
Figure 2:
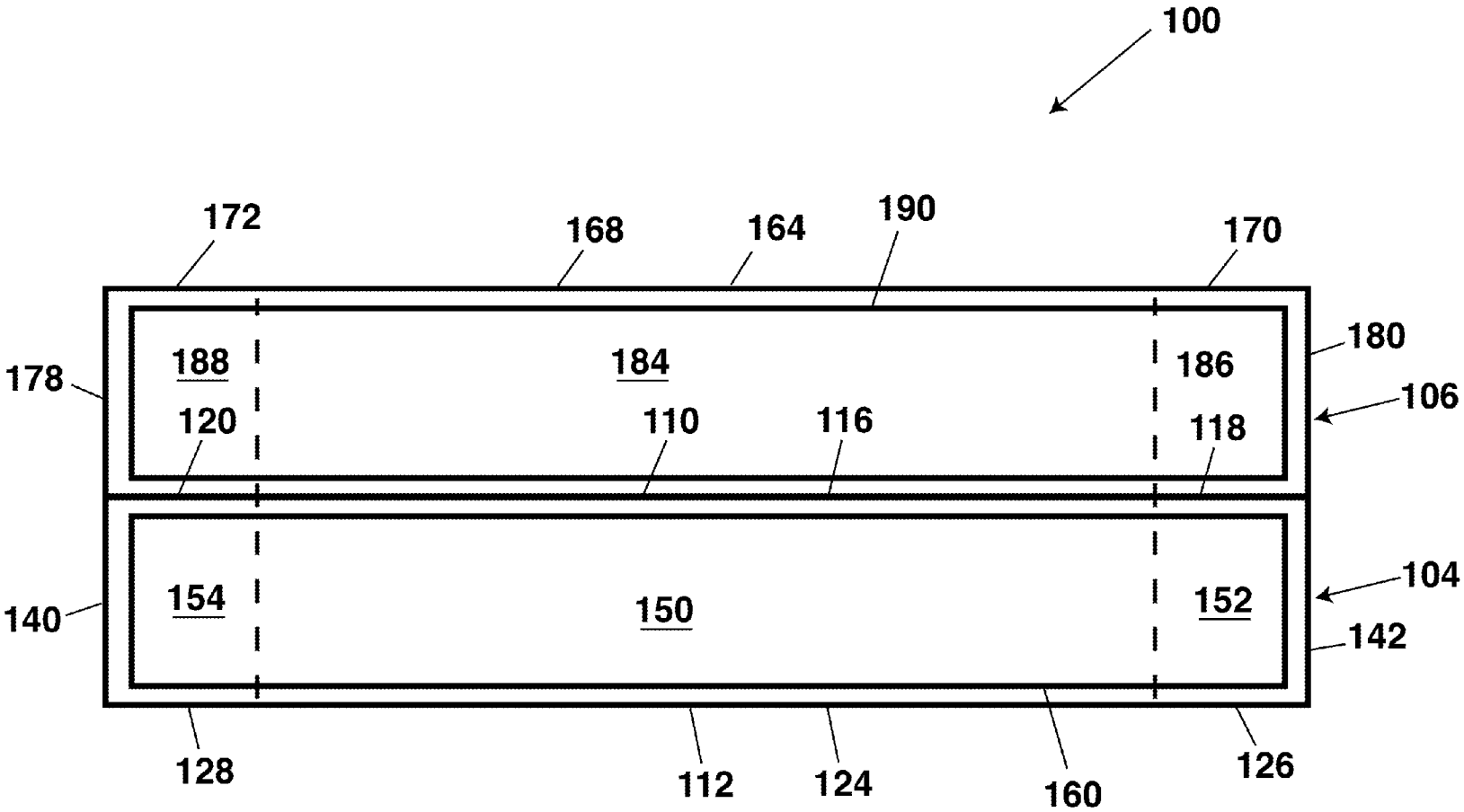
FIG. 2 is a top plan view of the trampoline of FIG. 1.

The trampolines described herein overcome many of the above problems by reducing the number of support members that are located in the trampoline court. Examples of such trampolines and trampoline courts are shown in FIGS. 1 and 2, which are described together in the following description. FIG. 1 shows a side elevation view of an embodiment of a trampoline court 100. The view of FIG. 1 only shows one trampoline 104 as a side view. FIG. 2 shows a top plan view of the trampoline court 100 of FIG. 1. The trampoline court 100 described herein has two trampolines, the first trampoline 104, and a second trampoline 106, which are described in greater detail below. It is noted that the trampoline court 100 may have any number of trampolines located therein.

Reference is made to the first trampoline 104 in the following description. It is noted that the second trampoline 106 is substantially similar, and in some embodiments, identical, to the first trampoline 104. The first trampoline 104 has a first support member 110 and a second support member 112 substantially aligned with the first support member 110. The support members 110, 112 may be made of a number of rigid materials, such as steel and/or aluminum, that are capable of supporting the trampolines 104, 106. The side defined by the first support member 110 is sometime referred to as the first side of the first trampoline 104. The side defined by the second support member 112 is sometimes referred to as the second side of the first trampoline 104.

The first support member 110 has a first portion 116, a second portion 118, and a third portion 120. Likewise, the second support member 112 has a first portion 124, a second portion 126, and a third portion 128. The first portion 116 of the first support member 110 is aligned with or substantially aligned with the first portion 124 of the second support member 112. The second portion 118 of the first support member 110 is aligned with or substantially aligned with the second portion 126 of the second support member 112. The third portion 120 of the first support member 110 is aligned with or substantially aligned with the third portion 128 of the second support member 112. In addition to the portions, the first trampoline 104 has a first end 140 and a second end 142 located opposite the first end 140.

A first plane or area 150 is defined as being located between the first portions 116, 124. A second plane or area 152 is defined as being located between the second portions 118, 126. A third plane or area 154 is defined as being located between the third portions 120, 128. As shown in FIG. 1, the third area 152 intersects the first area 150 at an angle θ1, and the third area 154 intersects the first area at an angle θ2. The angles θ1 and θ2 are less than 180 degrees. In some embodiments, the angles θ1 and θ2 are 135 to 140 degrees. The angle θ1 is established by the angle of intersection of the second portions 118, 126 with the first portions 116, 124. Likewise, the angle θ2 is established by the intersection of the third portions 120, 128 with the first portions 116, 124.

In some embodiments, the second area 152 and/or the third area 154 is curved or has a curved transition to the first area 150. In such embodiments, the angles θ1 and θ2 may not exist. In this embodiment, the second areas 152, 186 and/or the third areas 154, 188 may be substantially located on planes that intersect planes defining the first areas 150, 184 at the angles described above.

A single piece of first material 160 substantially or completely extends between the first support member 110, the second support member 112, the first end 140, and the second end 142. A single piece of material means that the material does not have any intervening rigid support members; although, it may be made of several connected pieces of material. The material 160 is of the type commonly used in trampolines. The material 160 substantially or completely covers the first area 150, the second area 152, and the third area 154. Thus, a user of the first trampoline 104 is able to bounce between the first end 140 and the second end 142 without encountering any support members or areas without material. Accordingly, the effective bouncing area is between the first end 140 and the second end 142. It is noted that the material 150 is connected to the first support member 110, the second support member 112, the first end 140, and the second end 142 by springs, spring-type materials, or spring-like mechanisms.

The second trampoline 106 may use the first support member 110 as one of its support members. Thus, there may only be one support member between the first trampoline 104 and the second trampoline 106, which increases the effective bounce area over conventional trampoline courts. The second trampoline 106 has a third support member 164 that is aligned with or substantially aligned with the first support member 100. The third support member 164 includes a first portion 168, a second portion 170, and a third portion 172 that are aligned with the corresponding portions 116, 118, 120 of the first support member 110. As with the first trampoline 104, the second trampoline 106 may have a first end 178 and a second end 180.

The second trampoline 106 has three planes or areas similar to the first trampoline 104. A first area 184 may be on substantially the same plane as the first area 150. A second area 186 may be on substantially the same plane as the second area 152. A third area 188 may be on substantially the same plane as the third area 154.

A single piece of second material 190 may extend between the first support member 110, the third support member 164, the first end 178, and the second end 180 and be supported thereto by springs or the like. The second material 190 may be substantially similar to the first material. As shown in FIGS. 1 and 2, the trampoline court 100 may have a horizontal area corresponding to the first areas 150 and 184. A first incline defined by the areas 152 and 186 may intersect the horizontal area. A second incline located opposite the first incline and defined by the areas 154 and 188 may intersect the horizontal area. Thus, the trampoline court 100 includes a flat area and two inclined areas with only one area of the first support member 100 that lacks an effective bounce area. Therefore, a user is able to use a greater portion of the trampoline court 100 for bouncing than in conventional trampoline courts.

It is noted that in some applications, the trampolines 104, 106 may have only one inclined portion. For example, a trampoline may have a horizontal portion and only one inclined portion intersecting the horizontal portion. Such a trampoline may, as an example, not have the inclined portion corresponding to the areas 154, 188. It is also noted that, as described above, the second areas 152, 186 and/or the third areas 154, 188 may be curved instead of planar.

The trampolines 104, 106 may have a plurality of legs or supports 190 that maintain the trampolines 104, 106 above a floor or the like. In some embodiments, the first ends 140, 178 and the second ends 142, 180 may be located proximate vertical walls. Accordingly, the ends 140, 142, 178, 180 and their corresponding portions may have supports extending to the vertical walls.

Figure 3:
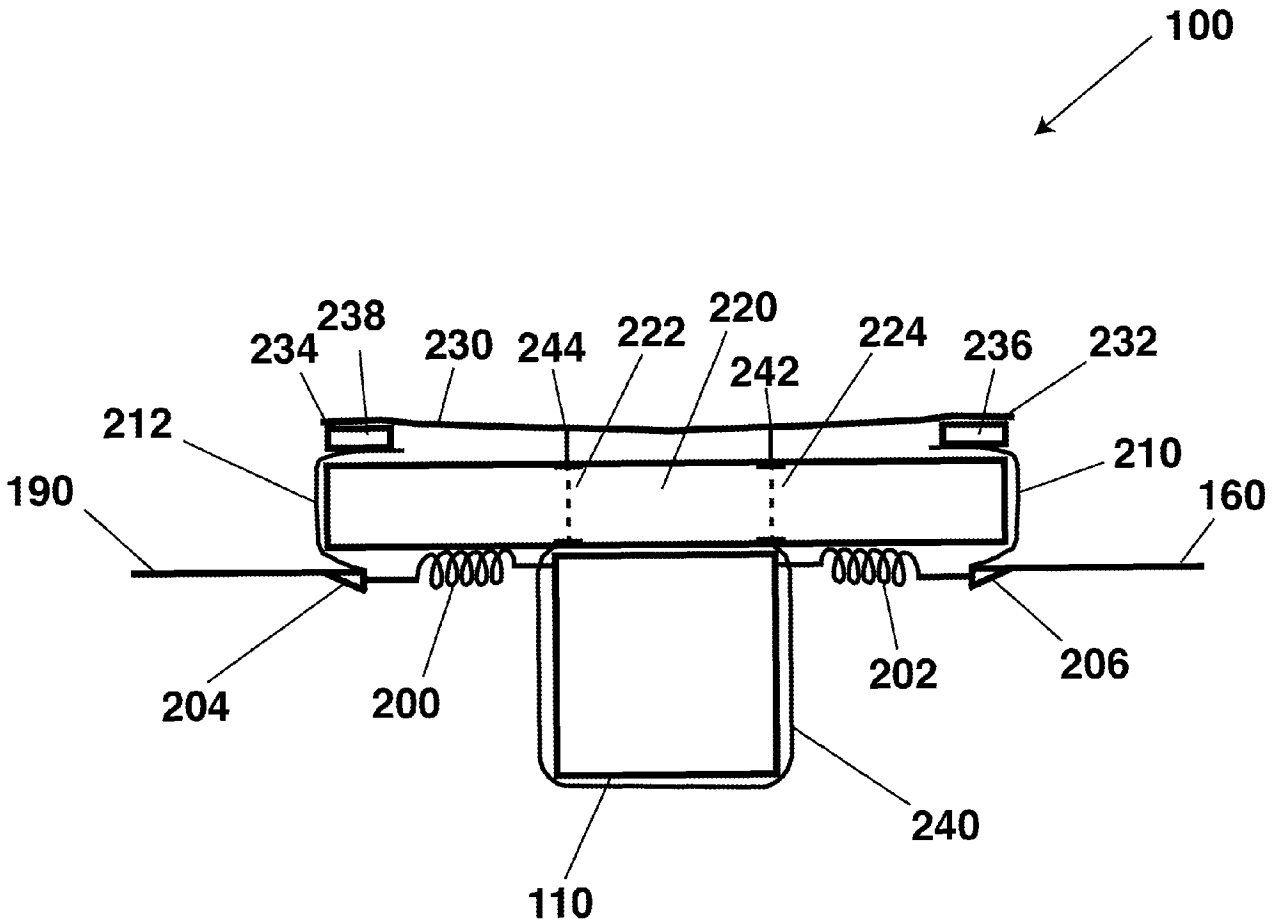
FIG. 3 is a side cut away view of a support member of the trampoline of FIG. 1 showing an embodiment of attaching padding to the trampoline.

Some embodiments of the trampoline court 100 may include padding that covers the support members 110, 112, 164. An embodiment of the padding is shown in FIG. 3, which is a side cut away view of the first support member 110. The material 160, 190 is attached to the first support member by way of springs 200, 202. The first support member 110 may include a plurality of connectors that secure a plurality of springs 200, 202 to each material 160, 190. The springs 200, 204 connect to the material 160, 190 at locations 204, 206. The locations 204, 206 may include reinforcing devices (not shown), such as grommets or the like.

The first material 160 has a first extension 210 extending therefrom. The first extension 210 may be a section of the first material 160 or a material that is attached to the first material 160. The second material 190 has a second extension 212 extending therefrom in a similar manner as the first material 160.

A pad 220 sets on the first support member 110. The pad may be similar to a standard safety pad used in conventional trampolines. The pad 220 has a first slot 222 and a second slot 224 cut therethrough. The pad 220 may cover the springs 200, 202 and may extend onto the material 204, 206.

A cover 230 is positioned over the pad 220. The cover 230 has a first end 232 and a second end 234. The first end 232 connects to the first extension 210 and the second end 234 connects to the second extension 212. For example, the ends 232, 234 and the extensions 210, 212 may have a hook and latch fastening mechanisms 236, 238, such as Velcro, that connects them together.

A strap 240 is attached to the cover 230 at positions 242 and 244. The positions 242 and 244 correspond to the slots 222 and 224. The strap 240 extends from the position 242, through the first slot 224, around the first support member 110, through the second slot 222, and to the position 244. It is noted that the strap 240 may be in two pieces that attached to each other proximate the first support member 110. The strap 240 may be tightened to secure the pad 220 and other components associated therewith in a fixed location relative to the first member 110.

The cover 230 is shown as being raised above the pad 220 for illustration purposes. In use, the cover 230 may lay against the pad 220. In addition, the strap 240 may be tight against the first support member 110, but is shown as being loose for illustration purposes.

The extensions 210, 212 prevent users from slipping under the pad 230 and contacting the springs 200, 202. The cover 230 protects the pad 230 from being torn or damaged by users. The strap 240 maintains the cover 230 and the pad 220 in a fixed location relative to the first support member 110 and the springs 200, 202. In use, a user may contact the cover 230 from virtually any angle and the pad 220 will not dislodge from its fixed position. Accordingly maintenance requirements of the trampoline court 100, FIG. 2, are significantly reduced as are injuries.

What is claimed is:

1. A trampoline comprising:

only a single first support member having a plurality of portions;

a second support member having a plurality of portions;

a first support member first portion being aligned with a second support member first portion, the area between said first support member first portion and said second member first portion being a first plane;

a first support member second portion being aligned with a second support member second portion, the area between said first support member second portion and said second support member second portion being a second plane;

a piece of first material substantially covering said first plane and said second plane;

a third support member aligned with said first support member and located on an opposite side of said first support member as said second support member; and a piece of second material extending between at least one location proximate said first support member and at least one location proximate said third support member;

wherein said first plane intersects said second plane at an angle less than one hundred eighty degrees.

2. The trampoline of claim 1, and further comprising:

a first support member third portion being aligned with a second support member third portion, the area between said first support member third portion and said second member third portion being a third plane;

wherein said first member third portion and said second member third portion being at opposite ends of said first and second support members as said first member second portion and said second member second portion;

wherein said first plane intersects said third plane at an angle less than one hundred eighty degrees; and wherein said piece of first material substantially covers said third plane.

3. The trampoline of claim 1, wherein at least one spring device connects said piece of material to said first support member.

4. The trampoline of claim 1, and further comprising a pad having a first surface and a second surface located opposite said first surface, said pad first surface being located adjacent said first support member.

5. The trampoline of claim 4, wherein said pad comprises a plurality of holes, and further comprising a strap extending through at least two of said holes and around said first support member.

6. The trampoline of claim 4, and further comprising a first cover located adjacent said second surface of said pad.

7. The trampoline of claim 6, and further comprising a third material extending between said first material and said cover.

8. The trampoline of claim 7, wherein at least a portion of said third material is located between said pad second surface and said cover.

9. The trampoline of claim 7, wherein said third material is attachable to said cover.

10. The trampoline of claim 6, and further comprising a fourth material extending between said second material and said cover.

11. The trampoline of claim 10, wherein at least a portion of said fourth material is located between said pad second surface and said cover.

12. A trampoline court comprising:

a first trampoline comprising:

only a single first support member having a plurality of portions;

a second support member having a plurality of portions;

a first support member first portion being aligned with a second support member first portion, the area between said first support member first portion and said second support member first portion being a first plane;

a first support member second portion being aligned with a second support member second portion, the area between said first support member second portion and said second support member second portion being a second plane;

a piece of first material substantially covering said first plane and said second plane;

wherein said first plane intersects said second plane at an angle less than one hundred eighty degrees;

a second trampoline located adjacent said first trampoline, wherein said first trampoline and said second trampoline share said first support member.

13. The trampoline of claim 12, wherein said first plane intersects said second plane at an angle of between 135 and 140 degrees.

14. The trampoline court of claim 12 and further comprising:

a first support member third portion being aligned with a second support member third portion, the area between said first support member third portion and said second member third portion being a third plane; and a piece of material substantially covering said third plane; and wherein said third plane intersects said first plane at an angle less than one hundred eighty degrees.

* * * * *